US006112494A

United States Patent [19]

Hardy, Jr. et al.

[11] Patent Number: 6,112,494

[45] **Date of Patent: *Sep. 5, 2000**

[54] SYSTEM FOR AFFIXING REBAR LATTICE TO RECEIVE CONCRETE

[75] Inventors: Robert M. Hardy, Jr., Taylor Lake Village; Louis A. Waters, Jr., Bellaire, both of Tex.

[73] Assignee: Hardy Construction Products, L.L.C., Houston, Tex.

[ * ] Notice: This patent is subject to a terminal disclaimer.

[21] Appl. No.: 08/649,051

[22] Filed: May 16, 1996

[51] Int. Cl.[7] ..... E04C 5/20

[52] U.S. Cl. ..... 52/685; 52/686; 52/687

[58] Field of Search ..... 52/677, 680, 684, 52/685, 686, 687, 688, 679, 689; 428/200.1, 214

[56] References Cited

U.S. PATENT DOCUMENTS

| | | | |
|---|---|---|---|
| 1,613,351 | 1/1927 | Klinger et al. | 52/684 X |
| 3,105,423 | 10/1963 | Reiland | 52/684 X |
| 3,277,556 | 10/1966 | Platt et al. | 52/677 X |
| 3,378,981 | 4/1968 | Horne . | |
| 3,464,661 | 9/1969 | Alesi, Jr. | 52/677 X |
| 3,673,753 | 7/1972 | Anderson | 52/685 |
| 3,788,025 | 1/1974 | Holmes | 52/686 X |
| 4,007,572 | 2/1977 | Ilukowicz | 52/687 |
| 4,617,775 | 10/1986 | Padrun | 52/684 |
| 4,835,933 | 6/1989 | Yung | 52/685 |
| 5,400,562 | 3/1995 | Bahr | 52/677 X |
| 5,421,136 | 6/1995 | Van De Peer | 52/677 X |

FOREIGN PATENT DOCUMENTS

| | | | |
|---|---|---|---|
| 1484980 | 1/1969 | Germany | 52/677 |

*Primary Examiner*—Michael Safavi

*Attorney, Agent, or Firm*—Akin, Gump, Strauss, Hauer & Feld, L.L.P.

[57] ABSTRACT

An apparatus for fixating and elevating an interconnected rebar lattice having individual longitudinal and transverse rebar intersections for use as support for poured concrete in highway and other construction. The apparatus including a holding portion having an open ended recess with two opposing walls being generally U-shaped. The recess has a longitudinal axis and is sized and shaped to receive a longitudinal rod. An arc-shaped portion extends laterally outward from each opposing wall and perpendicular to the longitudinal axis of the recess. The arc-shaped portion has a transverse axis and is sized and shaped to receive a longitudinal rod. the arc-shaped portion includes a recess and opposing walls with one wall including a snap-type lock. A locking member has a generally arc-shaped portion and includes a snap-type lock for attaching to the arc-shaped portions and engaging with the snap-type lock of the arc-shaped portions. A leg portion extends downwardly from the holding portion. The holding member is adapted to secure the individual longitudinal and transverse rebar intersections of the rebar lattice in a locking relationship while the leg portion holds the interconnected rebar lattice in a preselected elevated position.

12 Claims, 6 Drawing Sheets

SYSTEM FOR AFFIXING REBAR LATTICE TO RECEIVE CONCRETE

SPECIFICATION

1. Field of the Invention

This invention relates to a system for elevating a reinforcing bar lattice work (or "rebar mat") which is known to be used as a reinforcement and support for poured concrete in roadway construction and other slab type construction, and more specifically to devices capable of supporting the rebar mat and of fasteneing together the individual rebar members to form a unitized rebar mat section, in such a manner as to prevent the rebar mat from rotating off the support devices and from experiencing angular deformation during the concrete pour.

2. Background of the Invention

For many years concrete roadways and other concrete slabs have incorporated reinforcing steel laid out in a rectangular lattice pattern for the purpose of adding strength to the concrete to resist slab failure when cracks develop in the concrete due to normal environmental conditions and heavy use. When cracks in the concrete develop the mat lattice work of the reinforcing bars perform the function of holding the concrete together at the point of the crack, preventing separation of the concrete and failure of the slab. In order for the reinforcing bars to effectively perform this function, however, engineers have determined that the rebar mat should be located at the center of the poured slab. The normal preferred location is in the center of the slab, referred to as Thickness/2 or t/2. The rebar mat also must retain its designed rectangular lattice shape in order for the longitudinal and transverse rebar sections to provide the maximum reinforcing strength at anticipated cracking areas, and in order for the rebar ends of each section to line up with the rebar ends of the next adjoining section of the next mat as the concrete slab is constructed. For many years contractors and public road building engineers have been aware that current methods for building the rebar mat and elevating the mat off the surface of the roadbed or slab often fail to keep the rebar mat in the desired location and shape after the concrete pour, which results in premature failure of the concrete road or slab.

Currently, rebar mats used in road construction are built using a three step method: (1) having laborers lay out the rebar sections, with the designed rebar section spacing on the roadbed in the location where the rebar mat section is to be assembled; (2) once the rebar sections have been laid out, lifting the rebar sections off the surface of the roadbed and placing devices, known as "rebar chairs," under the rebar sections to elevate the rebar mat to the desired height and then setting the rebar on top of the rebar chairs usually in a slot built into the chair; and (3) tying the rebar sections together with wire at the rebar intersections in order to hold the rebar sections in a mat type structure.

This traditional method for building rebar mats is deficient in two major respects. First, the rebar chairs are held upright by the base of the chair sitting on the roadbed and are not firmly locked to the rebar mat sections. When lateral forces, common on the job site, are exerted against the rebar mat, the chairs can rotate off of the rebar mat section and the entire rebar mat can fall to the roadbed. This situation can also occur during the pouring of the concrete when the lateral forces exerted by the in-flowing concrete can knock over the rebar chairs, causing the entire mat within the slab to sag to the ground after the concrete is poured. Second, the wire tied rebar intersections provide no strength against angular deflection of the rebar, known as racking, when extreme forces of the concrete pour and the paving vibrator are applied. This method of mat conctruction often results in a rebar mat that is deformed into a parallelogram shape, that has less support strength, and misaligned rebar ends for attaching to the next adjoining section of rebar mat. These problems have been exacerbated in recent years with the growing use of less viscous, quick drying concrete mixtures.

Since this is such a difficult problem, there have been a number of attempted solutions. One solution known to the inventor is a device described in U.S. Pat. No. 3,378,981 that includes a generally rectangular box-like support made of sheet metal that has first and second vertically extending walls with each wall including a recess to receive rebar. Tabs stamped into the metal shape can be bent over to hold the rebar in place. The difficulty with this device is that the rebar connector is metal, which by being in contact with the road bed, forms a path for corrosion to travel to the rebar mat and greatly accelerate the corrosion of the entire rebar mat. Oxidation (formed by corrosion) of the rebar mat produces internal forces that will cause the entire slab to crack and fail. Consequently, these metal chairs are unacceptable for use in today's road construction. Moreover, the basic design of this generally rectangular box-like connector results in a space or pocket being formed by the intersection of three planes into which concrete will not flow. This produces a a void or hollow space in the concrete roadbed. This "voiding" problem has been exacerbated today because of the use of "stiffer" concretes, which are poured with a viscosity higher than in previous years. Consequently, the propensity for forming "voids" in the concrete prevent the use of these rectangular metal chairs in any publicly funded roadway and highway construction. In addition, because the chairs are constructed of metal they offer no resistance to racking forces. The metal chairs simply bend to accommodate the deformed shape of a racked rebar mat.

The most popular rebar chair in use today is a plastic "tee-pee" shaped chair having a triangular shape, that is wider at the bottom and narrows to a point at the top where a U-shaped saddle acts as a receiver for rebar placed on top of the chair. Often the U-shaped saddle section is formed so as to snap around a portion of the rebar when it is lowered into the saddle section. The tee-pee chairs are made of various types of plastic, selected primarily upon manufacturing costs considerations. The design of this chair provides no means to prevent the chair from rotating off the rebar when lateral forces are applied to the mat, either before or during the concrete pour. Furthermore, these tee-pee chairs offer no resistance to the racking forces applied to the rebar mat during the concrete pour.

The practice of tying the rebar intersections with wire does mitigate against the transverse rebar sections from sliding along the mat during the concrete pour, although this effect is not entirely eliminated. The wire tied joints, however, provide no support at the intersections of the rebar sections to resist forces tending to deform the entire mat into a parallelogram. Thus, racking of the rebar mat remains a constant problem with today's less viscous concrete mixes used in roadway construction.

A primary concern for the contractor is that the current method is extremely labor intensive. As discussed above, three separate steps are required to be performed by laborers at the location of the mat building. These steps include (1) laying out the rebar sections, (2) installing the chairs under the rebar mat, in sufficient quantities to hold the mat off the roadbed, and (3) making a second trip down the rebar mat to wire tie the rebar intersections together. The current invention overcomes these problems by providing chairs that will not rotate off the rebar when lateral forces to the rebar mat are encountered and can be installed with a minimal increase in labor. The chairs of the current invention also eliminate the need for the second trip down the rebar mat to tie the rebar sections together as this function is incorporated into the basic design of the invention so that the rebar sections are attached together at the same time the chairs are attached to the mat. The chairs of the current invention also provide substantial anti-racking support at the rebar intersections. Additional anti-racking strength results from the use of special locking mat couplers which are attached to the rebar ends where the mat sections meet, thus utilizing the entire anti-racking strength of the rebar mat to resist the racking forces at the point where the forces are applied. The chairs and couplers of the subject invention, when used as a system, eliminate the possibility of mat failure during the concrete pour, either due to collapse of the mat to the road bed or from racking. The system of the subject invention also substantially lowers the amount of labor required to build the rebar mat by allowing the mat building process to be completed in a single trip down the mat.

The invention also incorporates an apparatus relating to the construction of multiple layer rebar mats which are in common usage in high traffic volume highways, particularly in urban areas. Current methods for building double and triple layer rebar mats involve simply building multiple mats on top of one another, using increasingly higher chairs for the upper lever mats. This method retains all of the disadvantages of current rebar mat construction described above, and is further subjected to another more serious problem. As the chairs become increasing higher in length, their propensity to rotate or tip over increases. Thus, the potential of upper layers of rebar mat falling onto the lower layers is always present, in spite of the use of expensive high rise chairs purportedly designed to mitigate against this problem.

The basic chair of the present invention, can include a special locking section which allows multiple rebar mats to be constructed on the same chair. This assures the uniform separation of the multiple mats as designed by the project engineers. Presently, there is no known rebar chair that allows for the use of a single chair to construct and lock multiple layer rebar mats together at the predetermined height.

The chairs of the present invention are also designed so as to virtually eliminate the phenomenon of concrete voiding, which is commonplace in today's plastic chairs. The chair legs of the present invention tapper to the road bed, greatly reducing the size of the three plane intersections below the rebar mat, which results in minimal voiding potential. As discussed above, concrete voiding occurs at the intersection of the three planes that are designed into the base of all plastic chairs for vertical support. Because the chairs must be located beneath the rebar mat, the vibrators used in the concrete pour cannot exert direct forces on the concrete slurry below the mat. This results in air pockets forming in the chairs comers where the three planes (two vertical and one horizontal) intersect, creating voids in the base of the slab. Where voids are sufficiently numerous, the upward support force of the concrete is no longer uniform which over time increases increasing the likelihood of slab failure.

The locking cap of the chairs of the present invention also provides another significant advantage in the economics of rebar mat construction for roadways. The rebar mats of the present invention, once assembled, provide sufficient anti-racking force to the entire mat allowing the mats to be lifted and moved as a single unit. This allows for offsite construction of the mats and transportation to the job site as needed. This feature allows for substantial savings in the cost of rebar mat building and for faster completion of roadbed construction, resulting in as much as an 80% decrease in on-site time for laying the rebar mats.

SUMMARY OF THE INVENTION

This invention relates to an apparatus for fixating an interconnected rebar lattice having individual longitudinal and transverse rebar interconnections for use as support for poured concrete in roadway and other slab-type construction. The apparatus includes a holding portion having two open ended recesses, one on top of the other, with each having two opposing walls being generally U-shaped. One recess has a longitudinal axis and the second recess has a transverse axis with both being sized and shaped to receive a longitudinal rod and a transverse rod when placed onto the mat at the intersection of the rebar rods. One of the opposing walls of one of the recesses includes a locking means. A locking member has locking means for attaching to the arc-shaped portions and engaging with the locking means of one of the open ended recesses. The locking member includes a generally arc-shaped portion. A leg portion extends downwardly from the holding portion.

The holding member is adapted to secure the individual longitudinal and transverse rebar interconnections of the rebar lattice in a locking relationship while the leg portion holds the interconnected rebar lattice in a preselected elevated position.

The subject invention also includes an apparatus for use with multiple layers of rebar mat. In this alternative embodiment, the locking member includes a leg portion on top of the locking member which leg portion includes a second U-shaped portion for holding the rebar of an upper mat on the same apparatus, with a locking member affixed to the top of the second holding portion for locking the entire apparatus into place upon the double rebar section.

The subject invention also includes a system for forming a rebar mat composed of an interconnected rebar lattice at a location other than the designated final location for the mat, and moving the fully assembled mat into place and joining the mat sections together with cam-snap locking couplers for connecting rebar mats together into a single unitized mat.

DESCRIPTION OF THE DRAWING

The invention will become more apparent when the detailed description of exemplary embodiments is considered in conjunction with the appended drawings, in which.

DESCRIPTION OF THE PREFERRED EMBODIMENT

The present invention is a system for fixating an interconnected rebar latticework to form a rebar mat which is used as support for poured concrete in roadway and other slab-type construction. The rebar lattice is formed of individual longitudinal and transverse rebar rods which are interconnected at various individual intersections of the longitudinal and transverse rebar lattice structure in order to form a stable rebar mat that is used as support for poured concrete in the construction of roadways and other slab-type construction. One part of the system is a chair or apparatus 10 that is used to hold, secure and elevate an individual longitudinal and transverse rebar intersection that is formed by the rebar lattice structure.

Figure 5:
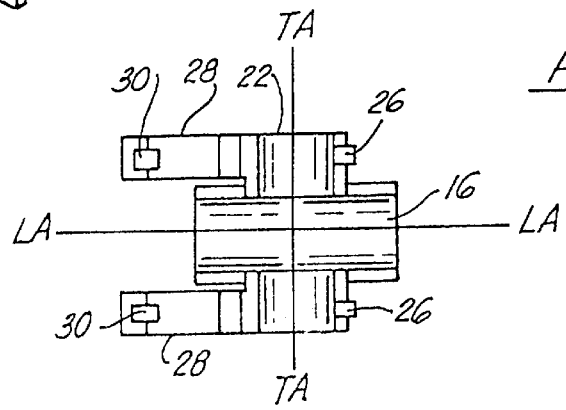
FIG. 5 is a top plan view of the embodiment illustrated in FIG. 1.
Figure 3:
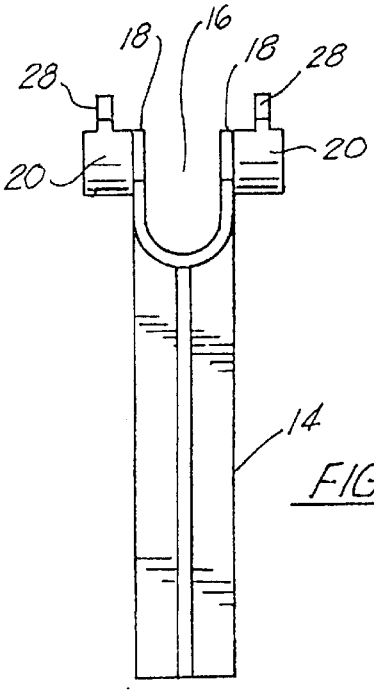
FIG. 3 is a back end plan view of the embodiment of FIG. 2.
Figure 4:
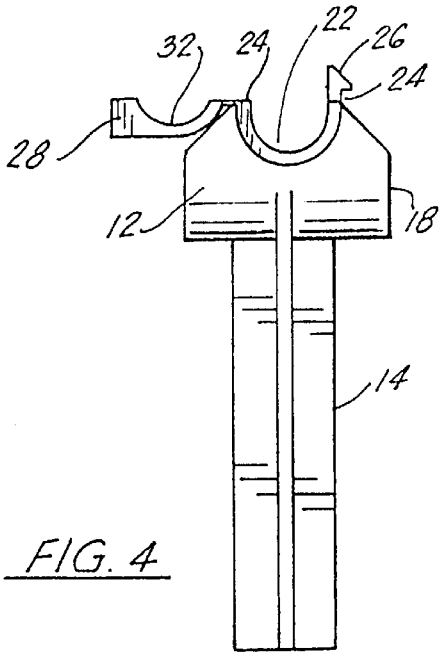
FIG. 4 is a side plan view of the embodiment illustrated in FIG. 1.

As shown in FIGS. 1–5, chair 10 includes a holding portion 12 and a leg portion 14. Holding portion 12 has an open ended recess 16 that is sized and shaped to receive a longitudinal rod (longitudinal rod not shown) such as the rebar that is used in roadway and slab-type construction. Holding portion 12 also includes two opposing walls 18 with the recess 16 and the opposing walls 18 forming a generally U-shape. Recess 16 includes a longitudinal axis LA, best illustrated in FIGS. 3 and 5. An arc-shaped portion 20 extends laterally and outwardly from each opposing wall 18 and is perpendicular to the longitudinal axis LA of recess 16, as illustrated in FIG. 3. Arc-shaped portions 20 have a transverse axis TA, as illustrated in FIG. 5, and are sized and shaped to receive a longitudinal rod (not shown) such as a rebar rod. Arc-shaped portions 20 have a recess 22 and opposing side walls 24 with one of the side walls 24 including a locking mechanism 26.

A locking cap or member 28 attaches to the arc-shaped portions 20 and includes a locking mechanism 30 for attaching the locking cap 28 to the arc-shaped portions 20. Locking member 28 also includes a generally arc-shaped portion 32 which is sized and shaped to receive a section of a rebar. The locking member 30 of the cap 28 engages and locks with the locking mechanism 26 of the arc-shaped portions 20. In a preferred embodiment, the locking mechanisms 26, 30 are of a releasable snap-type lock, as is known by one skilled in the art of plastic snap-type locking mechanism, that can generally be locked by the force of hand pressure. Preferably, the locking mechanisms 26 and 30 are of a releasable snap-type lock which can be snapped from an unlocked to a locked position without difficulty.

Figure 1:
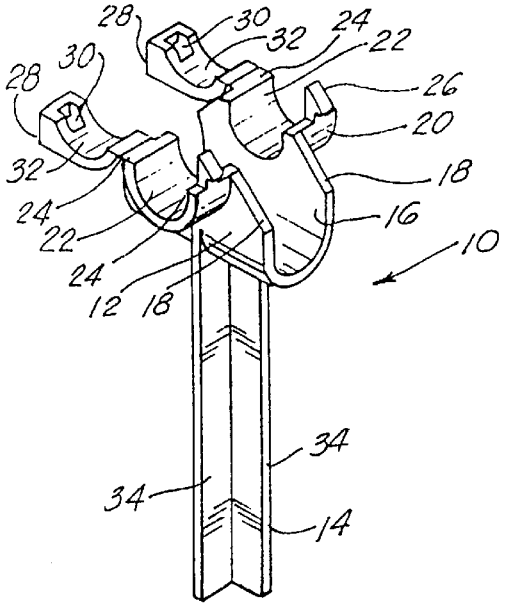
FIG. 1 is a perspective view of one of the embodiments of the present invention illustrating an unlocked position.
Figure 2:
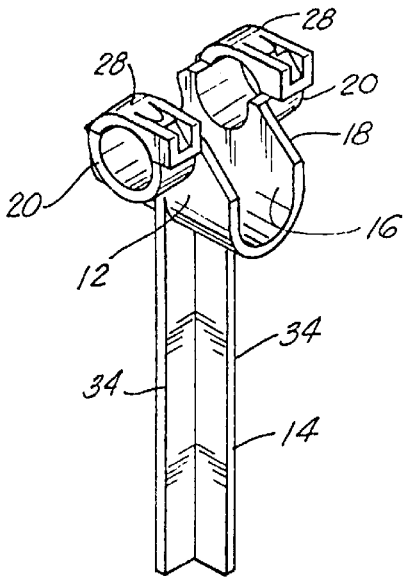
FIG. 2 is a perspective view of the embodiment of FIG. 1, illustrating a locked position.

In a preferred embodiment, locking cap 28 is formed of two sections with each section being flexibly attached to one each of the opposing walls 24 of each of the arc-shaped portions 20. Each of the locking cap 28 sections can be generally rectangular in shape with each section including the arc-shaped portion 32, as best illustrated in FIG. 1. Preferably, the flexible attachment of the cap sections 28 to the arc-shaped portions 20 forms a one piece hinge that is formed when certain types of plastic materials are used, known in the trade as a living hinge.

Figure 6:
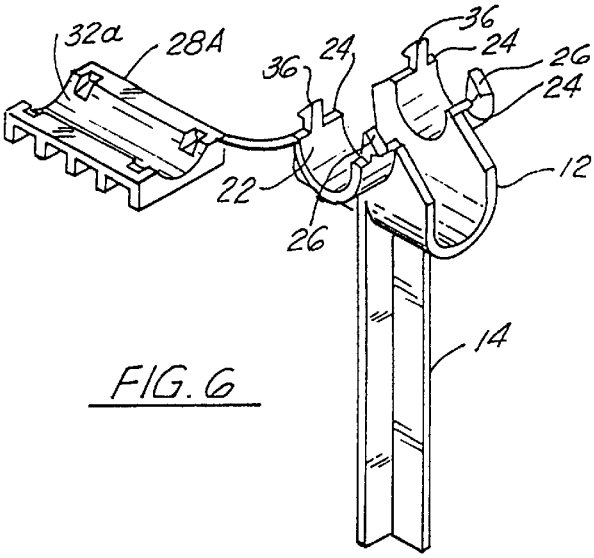
FIG. 6 is a perspective view of a second embodiment of the subject invention illustrating an unlocked position.
Figure 7:
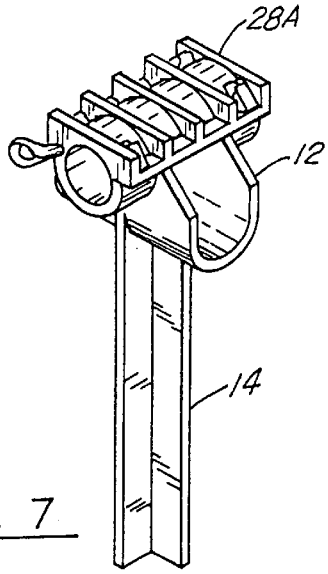
FIG. 7 is a perspective view of the embodiment of FIG. 6 illustrating a locked position.
Figure 8:
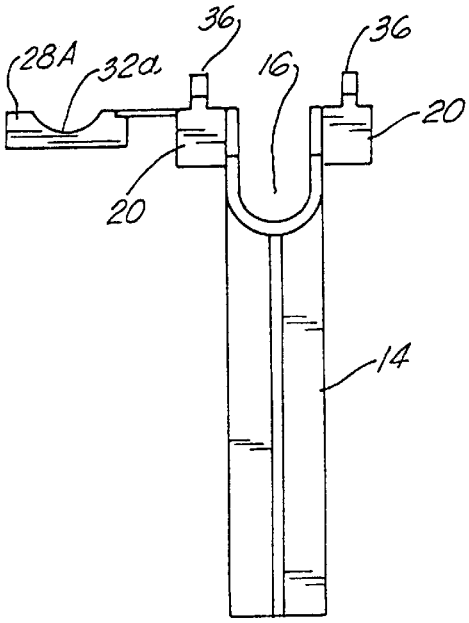
FIG. 8 is a back end plan view of the second embodiment illustrated in FIG. 6.
Figure 9:
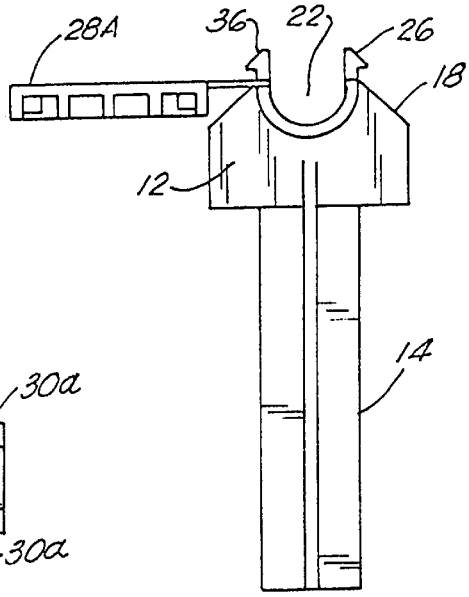
FIG. 9 is a side plan view of the second embodiment illustrated in FIG. 6.
Figure 10:
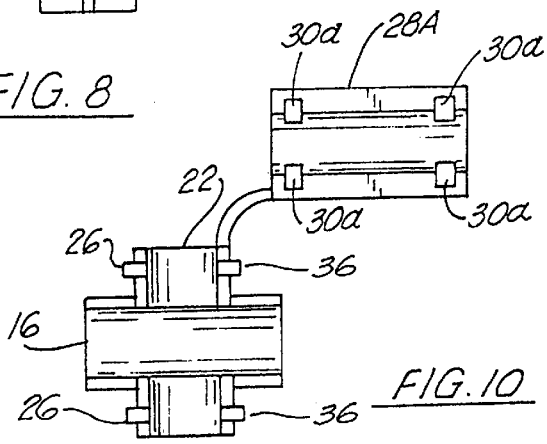
FIG. 10 is a top plan view of the second embodiment illustrated in FIG. 6.
Figure 11:
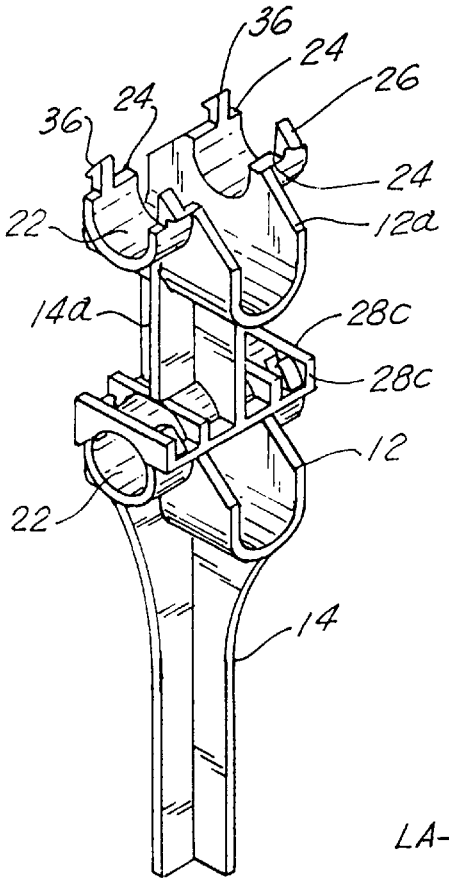
FIG. 11 is a perspective view of a third embodiment of the subject invention.
Figure 12:
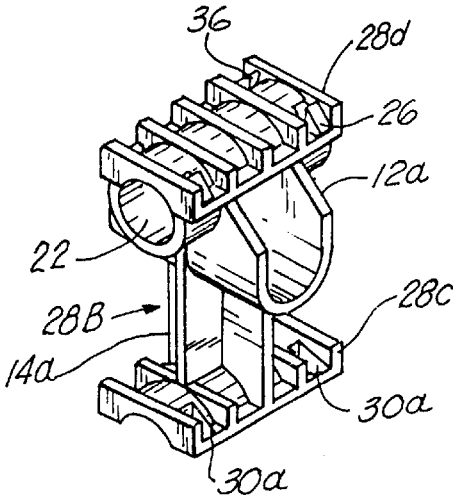
FIG. 12 is a perspective view of the alternate locking cap of the embodiment of FIG. 11.
Figure 15:
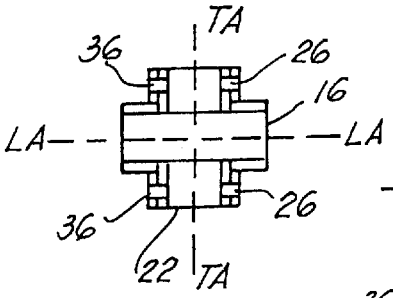
FIG. 15 is a top plan view of the third embodiment illustrated in FIG. 11.
Figure 14:
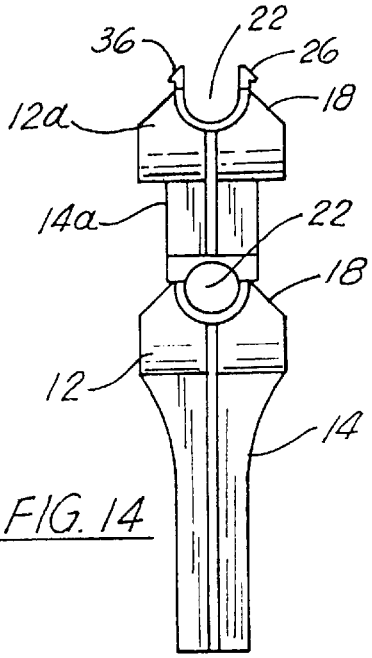
FIG. 14 is a side plan view of the third embodiment illustrated in FIG. 11.
Figure 13:
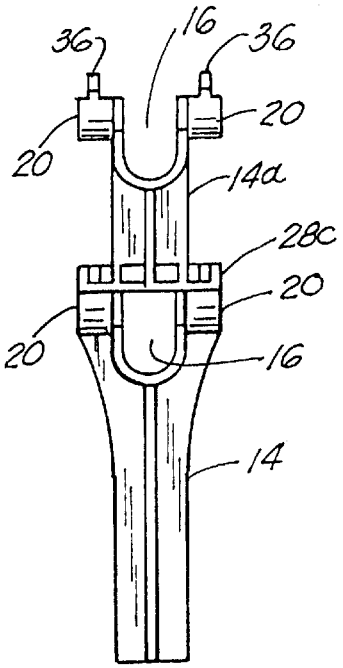
FIG. 13 is a back end plan view of the third embodiment illustrated in FIG. 11.

Alternatively, in applications where additional strength is desired, locking cap 28 can be formed of a single piece to form locking cap 28A, as illustrated in FIGS. 6–10. When the one piece locking cap 28A is used, holding member 12 includes a second locking mechanism 36 on one of each of the opposing walls 24 with the locking mechanism 36 being in alignment with the locking mechanisms 26 on the other opposing walls 24 of the arc portions 20. The one piece locking cap 28A is generally rectangular in shape and also includes an arc-like portion 32*a* which is placed along the entire length of the one-piece locking member 28A, as illustrated in FIG. 6. One piece locking cap 28A also includes at each of its four comers a locking mechanism 30*a* which engages with the locking mechanisms 26 and 36 on the arc-shaped portions 20. Locking mechanisms 26, 36 and 30*a* are of a non-releasable snap-type lock, known to one skilled in the art of plastic snap-type locks. In a preferred embodiment when the locking mechanisms 26, 36 and 30*a* are engaged, they form a non-releasable type lock which cannot be released once engaged. Preferably, the locking mechanisms 26, 36 and 30*a* are engaged by a force greater than the force available through hand pressure.

Another embodiment of the locking cap 28, double mat locking cap 28B, is illustrated in FIGS. 11–15. The double mat locking cap 28B is used when it is desirable to form a double rebar mat for support of thicker slabs used in road ways that have high traffic volume and vehicles with heavy loads. Locking cap 28B includes a base locking cap 28*c*, a holding portion 12*a*, a leg portion 14*a* and a top locking cap 28*d*. Base locking cap 28*c* is identical in structure to locking cap 28A except that a shortened chair 10 is attached to the top of base locking cap 28*c*. The shortened leg portion 14*a* is identical to leg portion 14, but in a preferred embodiment is generally 2 to 3 inches in height. Holding portion 12*a* is identical to the holding portion 12 of chair 10 and includes the locking mechanisms 26 and 36 as illustrated in FIG. 6. Top locking cap 28*d* is identical in structure to the locking cap 28A and serves the locking function as locking cap 28A.

The double mat locking cap 28B is used with the chair 10 in the same manner as the other locking caps 28 and 28A except it is used when a double mat is being formed with the rebar rather than a single mat. The first set of longitudinal and transverse rebar rods are put in place, the base locking cap 28*c* is locked in place and the second set of longitudinal and transverse rebar rods are put into the holding portion 12*a* and the top locking cap 28*d* is locked in place. In a preferred embodiment, the locking caps 28, 28A and 28B formed of a plastic material such as polypropylene or a reinforced nylon-type material. A third leg portion and holding portion could also be attached above locking cap 28*d* if a triple rebar mat is desired.

Leg portion 14 extends downwardly from the holding portion 12 and in a preferred embodiment is formed of two identical interconnected leg portions 34 with the two leg portions 34 having a generally X-shaped cross section. Preferably, leg portions 38 are each approximately ½ inch wide, ⅛ inch thick and the entire leg portion 14 is generally between about 3 to 8 inches long. The length of the leg portion 14 will depend upon the distance from the base upon which the chair 10 is to sit to the approximate middle portion or center of the slab in which the rebar lattice is to be placed. Preferably, the holding portion 12 and leg portion 15 are integrally formed of a plastic material such as polypropylene or a reinforced nylon-type material.

When chair 10 is assembled with either locking caps 28, one piece locking cap 28A or the double mat locking cap 28*b*, the arc-shaped portions of each cap 28, 28A, or 28*b* form a generally circular opening which engages and holds an individual transverse rebar in a locking connection with the longitudinal rebar placed below it.

Figure 16:
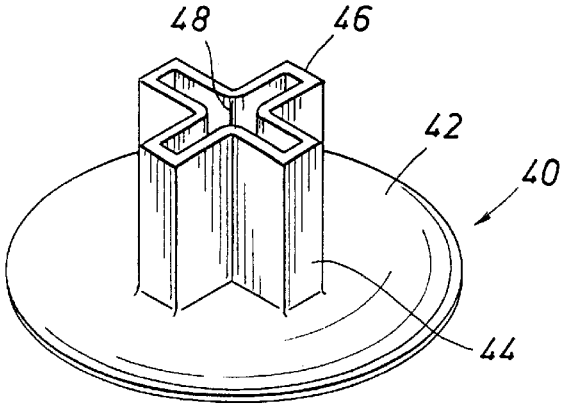
FIG. 16 is a perspective view of the stabilizing base of the present invention.
Figure 18:
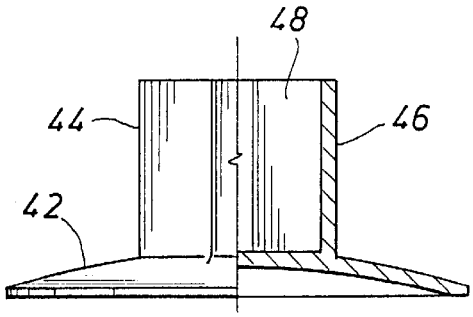
FIG. 18 is a partial cut-away view of the stabilizing base illustrated in FIG. 17 viewed across lines 18—18.
Figure 17:
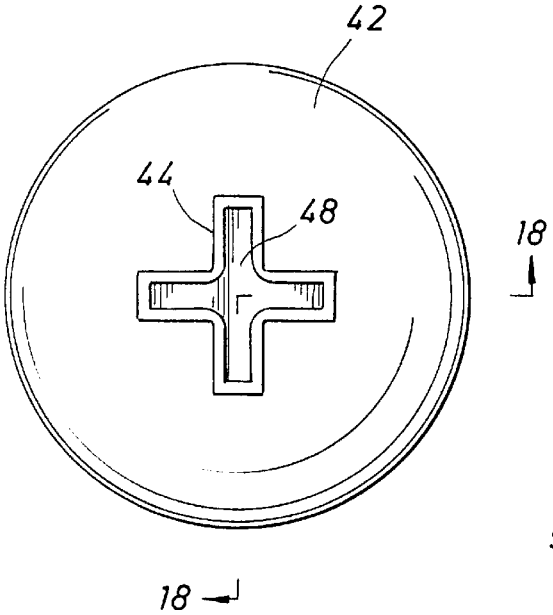
FIG. 17 is a top plan view of the stabilizing base illustrated in FIG. 11.

The system of the present invention also includes an apparatus for providing a base for the chair 10. As shown in FIGS. 16–18, a base 40 is used with chairs 10 when a rebar mat is being formed on unstable or soft bases, such as a dirt, sand or gravel road bed, a soft asphalt base due to heat or other unstable foundations, in order to prevent the chairs 10 from penetrating into the soft or unstable base of the road bed. The base 40 is not designed to hold the chair 10 in the upright position as this function is performed by locking the chair 10 to the rebar mat at the longitudinal and transverse rebar intersections. The base 40 has a generally circular base portion 42 and a centrally located holding portion 44 extending upwardly and perpendicular to the base portion 42. The holding portion 44 includes outer walls 46 and an opening 48 which is sized and shaped to accommodate and engage the leg portion 14 of the chair 10. In a preferred embodiment, the circular base has a radius of generally between 2 and 4 inches and the holding portion 44 is generally between about ¼ to ¾ inches high. Preferably, the base 40 is formed from a plastic such as polypropylene or alternatively a reinforced nylon material.

Another component of the system of the present invention is a coupler 50, illustrated in FIGS. 19–23, which is used to connect adjoining rebar mats used in the construction or road ways and other slab-type construction. The interconnected rebar lattice when used with the chairs 10 forms what is known as a rebar mat which forms the underlying steel supporting structure for road beds and other slab-type foundations. The rebar mats have portions or ends of rebar extending beyond the outer edges of the rebar mats which is used to connect adjoining rebar mats together when continuous road ways and multiple lanes are being formed.

Figure 19:
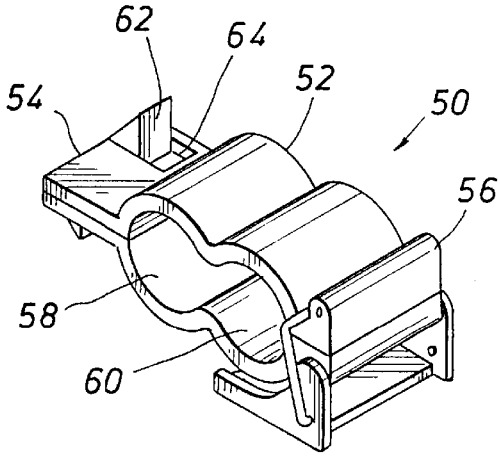
FIG. 19 is a perspective view of a coupler of the present invention.
Figure 23:
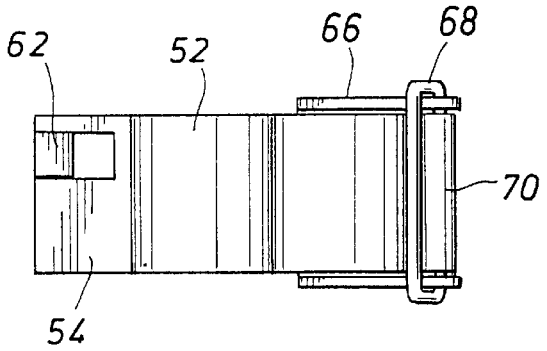
FIG. 23 is a top plan view of the coupler illustrated in FIG. 19.
Figure 20:
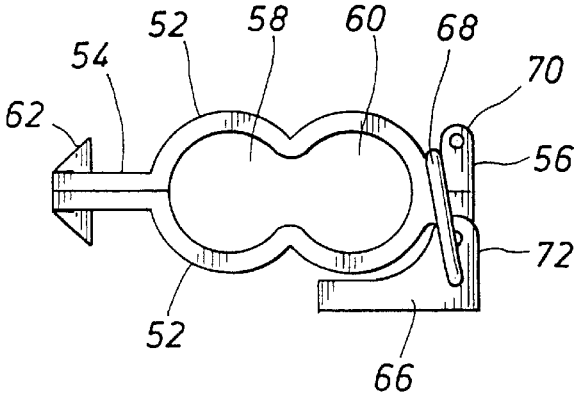
FIG. 20 is a side plan view of the coupler illustrated in FIG. 19.
Figure 21:
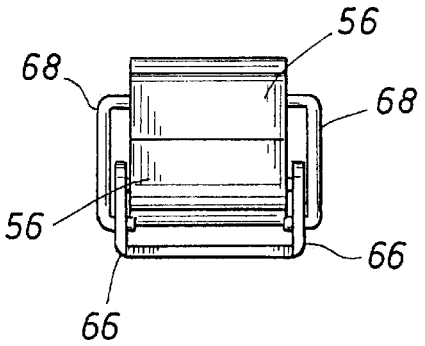
FIG. 21 is an end plan view of the coupler illustrated in FIG. 19.
Figure 22:
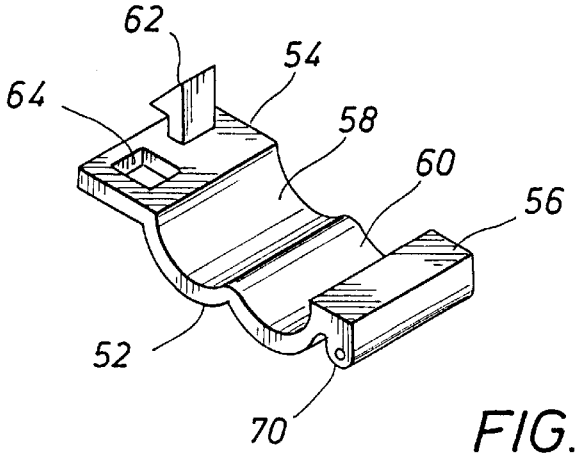
FIG. 22 is a perspective view of one of the members of the coupler illustrated in FIG. 19.

Coupler 50 connects the extending rebar ends together in order to join the mats together into a unitized structure. Coupler 50 is formed from two identical members 52 which are mated together in a face-to-face relationship to form the coupler 50, as shown in FIGS. 19 and 20. Member 52 is generally rectangular in shape, has a first end portion 54 and a second end 56 portion, and at least two adjoining arcuate portions 58 and 60 placed between the first and second end portions 54, 56 of member 52. First end portion 54 includes a locking mechanism, such as a non-releasable type snap lock, that includes a projection 62 and an opening 64 sized and shaped for snapping engagement with the projection 62. In a preferred embodiment, projection 62 and opening 64 are placed adjacent to each other so that when two members 52 are placed in face-to-face relationship with each other, projection 62 of one member 52 engages and snaps within the opening 64 of the other member 52. Second end portion 56 of member 52, in a preferred embodiment, includes a protrusion 70 for the attachment of a second locking mechanism. In order to form the coupler 50, second end portion 56 of one member 52 can include a releasable hinge-type lock that has a handle 66 in hinged engagement with the second end portion 56 and a locking bar 68 that is attached to the handle 66. The handle 66 is attached in a hinge-type engagement to the protrusion 70 on the second end portion 56. Handle 66 can be generally L-shaped with the short end 72 of the L attaching to the protrusion 70 of one member 52. Lock bar 68 is also attached to the short end 72 of handle 66, in alignment with the hinge-type attachment of member 52. Preferably, the members 52 of the coupler 50 are formed of a plastic material such as filled polypropylene or a reinforced nylon.

Coupler 50 is assembled by attaching handle 66 to the second end portion 56 of one member 52 and mating a second member 52 with it in a face-to-face relationship so that the locking mechanisms of the first end portions 54 engages the respective projections 62 and openings 64 of each member 52 in order to lock the two members 52 together at their first end portions 54. Handle 66 is extended outwardly from one member 52 in order to slip the lock bar 68 over the protrusion 70 of the second member 52. The handle 66 is then retracted or moved towards the arcuate portions 58, 60 of member 52 in order to tighten the lock bar 68 on the second member 52 and thus, lock the two members 52 into secured coupler 50 of the present invention.

Figure 24:
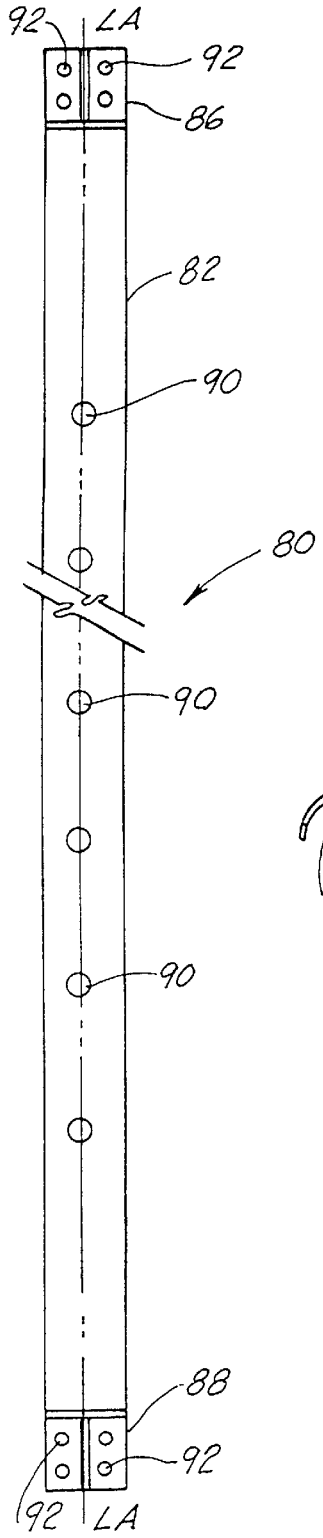
FIG. 24 is a top plan view of a template of the subject invention.
Figure 25:
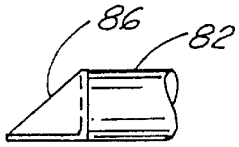
FIG. 25 is a side plan view of a portion of the longitudinal member illustrated in FIG. 24.
Figure 27:
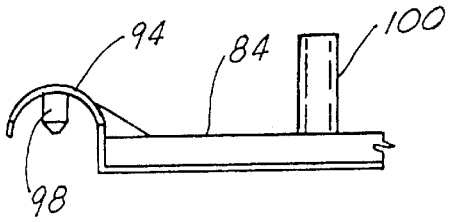
FIG. 27 is a side plan view of a portion of the transverse member illustrated in FIG. 26.
Figure 26:
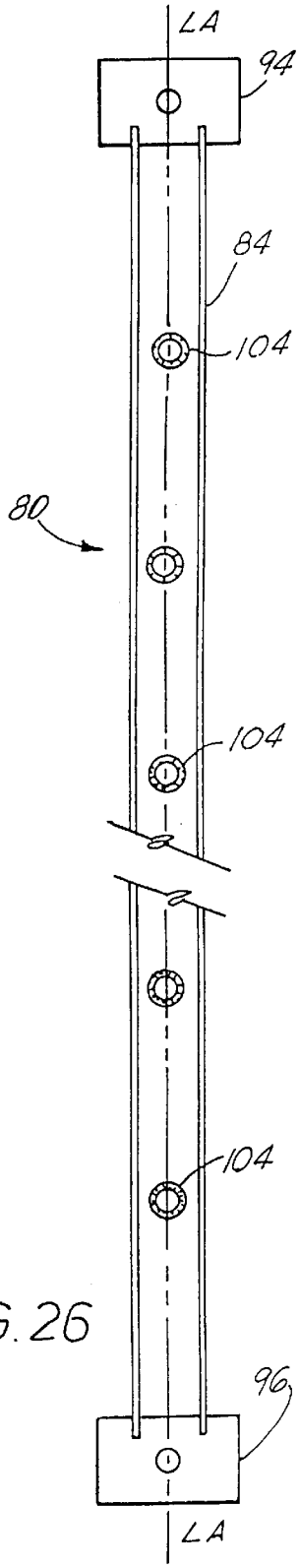
FIG. 26 is a top plan view of a transverse member of a template of the present invention.

The system of the subject invention also includes a template 80, as illustrated in FIGS. 24–27. Template 80 has two longitudinal members 82 and a plurality of transverse members 84 that are used to form a rebar mat composed of interconnected rebar lattice having individual longitudinal and transverse rebar intersections. Each longitudinal member 82 is at least sixty (60) feet in length and includes a first end 86 a second end 88. Longitudinal member 82 has a longitudinal axis LA and a plurality of evenly spaced openings 90 placed along the longitudinal axis LA of the longitudinal member 82 (FIG. 24). Perferably, the openings 90 are spaced generally six (6) feet apart. In a preferred embodiment, first and second ends 86, 88 of the longitudinal member 82 are cut or slanted at a generally 90° and include a plurality of openings 92 for securing the longitudinal members 82 to a supporting structure during the formation of the rebar mat. Spikes or any other securing mechanisms can be used to secure the first and second ends 86, 88 of the longitudinal members 82 to a support structure such as the ground or a wooden platform. In a preferred embodiment, the longitudinal members 82 are formed of aluminum pipe that is cylindrical in shape.

The plurality of transverse members 84 has a first end portion 94 and a second end portion 96 that are sized and shaped to engage with the openings 90 of the longitudinal members 82. In a preferred embodiment, the end portions 94, 96 are arcuate in shape in order to conform to the cylindrical shape of longitudinal members 82. Each of the arcuate-shaped end portions 94, 96 include a projection 98 on the end portions' 94, 96 under side that is sized and shaped to engage one of the plurality of openings 90 placed along the longitudinal members 82. In a preferred embodiment, the plurality of transverse member 84 are formed of steel channel.

Each transverse member 84 includes a plurality of holders 100 evenly spaced along the longitudinal axis LA of the transverse member 84, perferably, spaced at generally nine (9) foot intervals. Holders 100 extend upwardly and perpendicular to the longitudinal axis LA of each transverse member 84 with each holder 100 being sized and shaped to accommodate and hold the leg portion 14 of each of the chairs 10. In a preferred embodiment, the holders 100 are formed of steel pipe and each holder 100 is generally about nine (9) inches in height. Each of the transverse members is generally about 12 and ½ feet in length.

The template 80 is formed by placing the two longitudinal members 82 a spaced apart distance from each other and securing the ends 86, 88 of each of the longitudinal members 82 to a supporting structure or the ground. The plurality of transverse members 84 are placed transversely over each of the two longitudinal members 82, with each of the first and second end portions 94, 96 of the transverse members 84 being placed in an opening 90 of each of the two longitudinal members 82. The plurality of transverse members 84 are placed in parallel alignment along the longitudinal members 82. After the template 80 has been assembled, the chairs 10 are placed in each of the holders 100 and the rebar rods are placed both longitudinally and transversely across the template 80with the chairs 10 holding selected individual intersections of the longitudinal and transverse rebar rods. When the entire mat is assembled, the cap members 28A of the chairs 10 are locked in place, securing the rebar lattice into one connected rebar mat which can be moved from the template 80 and transported for placement upon the road bed at the desired location. If a double rebar mat is contstructed, the same process is used, except the double mat locking caps 28*b* are used.

With the use of the system of the present invention, the rebar mats may be assembled directly on the road bed or other slab-type foundation in which the chairs 10 with the locking caps 28 can be used. Alternatively, the template 80 may be used to form a rebar mat on site in which preferably the chairs 10 with the locking caps 28A or 28B are used. In this situation, the rebar mat is formed on the template 80 and then moved into position on the road bed. Alternatively, the rebar mats can be prefabricated off site, stacked on flat bed trucks and transported to the road way construction site for placement upon the road bed.

These and other features of this invention are included within the scope of this disclosure, which is intended to cover various modifications of the techniques, procedures, methods, materials and equipment as will be apparent to those in the art. It is intended that all such variations within the scope and spirit of this disclosure be embraced.

What is claimed is:

1. An apparatus for fixating and elevating an interconnected rebar lattice having individual longitudinal and transverse rebar intersections for use as support for poured concrete in roadway and other slab-type construction, comprising:

a) a holding portion having an open ended recess with two opposing walls being generally U-shaped, the recess having a longitudinal axis and sized and shaped to receive a longitudinal rod;

b) an arc-shaped portion extending laterally outward from each opposing wall and perpendicular to the longitudinal axis of the recess, the arc-shaped portion having a transverse axis and sized and shaped to receive a longitudinal rod;

c) the arc-shaped portions each having a recess and opposing walls with one wall including a locking means;

d) a locking member having a generally arc-shaped portion and a locking means for attaching to the arc-shaped portions and engaging with the locking means of the arc-shaped portions to form a circular opening;

e) a leg portion extending downwardly from the holding portion; and f) the holding portion adapted to secure the individual longitudinal and transverse rebar intersections of the rebar lattice in a locking relationship while the leg portion holds the interconnected rebar lattice in a preselected elevated position.

2. The apparatus of claim 1, wherein the leg portion is formed of two interconnected leg portions, the two leg portions having a generally X-shaped cross-section.

3. The apparatus of claim 1, wherein the locking member is a one piece member.

4. The apparatus of claim 1, wherein the locking means of the locking member and the arc-shaped portion includes a releasable snap-type lock.

5. The apparatus of claim 1, wherein the locking means of the locking member and the arc-shaped portion includes a non-releasable snap-type lock.

6. The apparatus of claim 1, wherein the holding portion and leg portion are integrally formed of polypropylene.

7. The apparatus of claim 1, further comprising:

a) a generally circular base portion;

b) a centrally located second holding portion extending upwardly and perpendicular to the base portion;

c) the second holding portion being sized and shaped to accommodate and engage the leg portion.

8. The apparatus of claim 7, wherein the base and second holding portion are integrally formed of polypropylene.

9. An apparatus for fixating and elevating two sets of interconnected rebar lattice having individual longitudinal and transverse rebar intersections for use as support for poured concrete in roadway and other slab-type construction, comprising:

a) a first holding portion having an open ended recess with two opposing walls being generally U-shaped, the recess having a longitudinal axis and sized and shaped to receive a longitudinal rod;

b) an arc-shaped portion extending laterally outward from each opposing wall and perpendicular to the longitudinal axis of the recess, the arc-shaped portion having a transverse axis and sized and shaped to receive a longitudinal rod;

c) the arc-shaped portions each having a recess and opposing walls with one wall including a locking means;

d) a locking member having a generally arc-shaped portion and a locking means for attaching to the arc-shaped portions and engaging with the locking means of the arc-shaped portions;

e) a leg portion extending downwardly from the first holding portion;

f) the first holding portion adapted to secure the individual longitudinal and transverse rebar intersections of a first rebar lattice in a locking relationship while the leg portion holds the first interconnected rebar lattice in a preselected elevated position;

g) the locking member further including a leg portion extending upwardly and perpendicular to the locking member and a second holding portion attached to the leg portion, said second holding portion being adapted to secure the individual longitudinal and transverse rebar intersections of a second set of rebar lattice in a locking relationship; and h) a second locking member for locking the individual longitudinal and transverse rebar intersections of the second set of rebar lattice in a locking relationship within the second holding portion.

10. The apparatus of claim 9, wherein the second holding portion further includes an open ended recess with two opposing walls being generally U-shaped, the recess having a longitudinal axis and sized and shaped to receive a longitudinal rod;

an arc-shaped portion extending laterally outward from each opposing wall and perpendicular to the longitudinal axis of the recess, the arc-shaped portion having a transverse axis and sized and shaped to receive a longitudinal rod;

the arc-shaped, portions each having a recess and opposing walls with one wall including a locking means.

11. The apparatus of claim 10, wherein the second locking member further includes locking means for attaching to the arc-shaped portions of the second holding portion and engaging with the locking means of the arc-shaped portions of the second holding portion the locking member having a generally arc-shaped portion.

12. The apparatus of claim 11, wherein the locking means of the locking members and the arc-shaped portions includes a non-releasable snap-type lock.

* * * * *